US009938984B2

(12) United States Patent
DiPietro, Jr. et al.

(10) Patent No.: US 9,938,984 B2
(45) Date of Patent: Apr. 10, 2018

(54) AXIAL COMPRESSOR ROTOR INCORPORATING NON-AXISYMMETRIC HUB FLOWPATH AND SPLITTERED BLADES

(71) Applicant: General Electric Company, Schenectady, NY (US)

(72) Inventors: Anthony Louis DiPietro, Jr., West Chester, OH (US); Gregory John Kajfasz, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 446 days.

(21) Appl. No.: 14/585,154

(22) Filed: Dec. 29, 2014

(65) Prior Publication Data

US 2016/0186772 A1 Jun. 30, 2016

(51) Int. Cl.

| | |
|---|---|
| ***F01D 5/14*** | (2006.01) |
| ***F04D 29/32*** | (2006.01) |
| ***F04D 29/68*** | (2006.01) |

(52) U.S. Cl.

CPC ..... *F04D 29/324* (2013.01); *F01D 5/143* (2013.01); *F01D 5/146* (2013.01); *F04D 29/329* (2013.01);

(Continued)

(58) Field of Classification Search

CPC ..... F01D 5/141; F01D 5/143; F01D 5/146; F04D 29/324; F04D 29/327; F04D 29/329; F05D 2260/961

See application file for complete search history.

(56) References Cited

U.S. PATENT DOCUMENTS 2,839,239 A * 6/1958 Stalker ..... F04D 21/00 415/181
2,920,864 A * 1/1960 Lee ..... F01D 5/145 415/914

(Continued)

FOREIGN PATENT DOCUMENTS

CN 101173672 A 5/2008
DE 611328 C 3/1935

(Continued)

OTHER PUBLICATIONS

European Search Report and Opinion issued in connection with corresponding EP Application No. 15182912.4 on May 23, 2016.

(Continued)

*Primary Examiner* — Ninh H Nguyen
(74) *Attorney, Agent, or Firm* — General Electric Company; Brian P. Overbeck

(57) ABSTRACT

A compressor apparatus includes: a rotor including: a disk mounted for rotation about a centerline axis, an outer periphery of the disk defining a flowpath surface having an non-axisymmetric surface profile; an array of airfoil-shaped axial-flow compressor blades extending radially outward from the flowpath surface, wherein the compressor blades each have a root, a tip, a leading edge, and a trailing edge; and an array of airfoil-shaped splitter blades alternating with the compressor blades, wherein the splitter blades each have a root, a tip, a leading edge, and a trailing edge; and wherein at least one of a chord dimension of the splitter blades at the roots thereof and a span dimension of the splitter blades is less than the corresponding dimension of the compressor blades.

15 Claims, 4 Drawing Sheets

(52) U.S. Cl.
CPC .... *F04D 29/681* (2013.01); *F05D 2220/3219* (2013.01); *F05D 2260/961* (2013.01)

(56) References Cited

U.S. PATENT DOCUMENTS

| | | | | |
|---|---|---|---|---|
| 2,953,295 | A | 9/1960 | Stalker | |
| 3,039,736 | A | 6/1962 | Pon | |
| 3,193,185 | A * | 7/1965 | Erwin | F01D 5/145 415/193 |
| 3,692,425 | A | 9/1972 | Erwin | |
| 4,512,718 | A | 4/1985 | Stargardter | |
| 5,002,461 | A | 3/1991 | Young et al. | |
| 5,152,661 | A | 10/1992 | Sheets | |
| 5,236,307 | A | 8/1993 | Ng et al. | |
| 5,299,914 | A | 4/1994 | Schilling | |
| 5,639,217 | A | 6/1997 | Ohtsuki et al. | |
| 6,017,186 | A * | 1/2000 | Hoeger | F01D 5/143 415/181 |
| 6,478,545 | B2 | 11/2002 | Crall et al. | |
| 6,508,626 | B1 | 1/2003 | Sakurai et al. | |
| 6,511,294 | B1 * | 1/2003 | Mielke | F01D 5/02 416/193 A |
| 6,910,855 | B2 | 6/2005 | Dailey et al. | |
| 7,094,027 | B2 | 8/2006 | Turner et al. | |
| 7,444,802 | B2 | 11/2008 | Parry | |
| 7,465,155 | B2 * | 12/2008 | Nguyen | F01D 5/143 415/191 |
| 8,167,548 | B2 | 5/2012 | Greim et al. | |
| 8,182,204 | B2 | 5/2012 | Durocher et al. | |
| 8,403,645 | B2 | 3/2013 | Barnes et al. | |
| 8,529,210 | B2 | 9/2013 | Merritt et al. | |
| 8,858,161 | B1 | 10/2014 | Ryznic et al. | |
| 8,920,127 | B2 | 12/2014 | McCaffrey | |
| 9,140,128 | B2 | 9/2015 | Aggarwala et al. | |
| 2007/0154314 | A1 | 7/2007 | Jarrah et al. | |
| 2013/0051996 | A1 | 2/2013 | Hoeger et al. | |
| 2014/0245741 | A1 | 9/2014 | He et al. | |
| 2014/0255159 | A1 | 9/2014 | Paradis et al. | |
| 2014/0314549 | A1 | 10/2014 | Pakkala et al. | |
| 2014/0328675 | A1 | 11/2014 | Derclaye et al. | |
| 2014/0348660 | A1 | 11/2014 | Guendogdu et al. | |

FOREIGN PATENT DOCUMENTS

| | | | | |
|---|---|---|---|---|
| EP | 0978632 | A1 | 2/2000 | |
| EP | 1927723 | A1 | 6/2008 | |
| EP | 2746534 | A1 | 6/2014 | |
| EP | 2799721 | A1 | 11/2014 | |
| FR | 2939852 | A1 | 6/2010 | |
| GB | 630747 | A | 10/1949 | |
| GB | 752674 | A | 7/1956 | |
| GB | 1514096 | A * | 6/1978 | F01D 5/142 |
| JP | 2001027103 | A | 1/2001 | |
| WO | 2009127204 | A1 | 10/2009 | |

OTHER PUBLICATIONS

European Search Report and Opinion issued in connection with related EP Application No. 15201288.6 dated May 9, 2016.
U.S. Non-Final Office Action issued in connection with related U.S. Appl. No. 14/585,158 dated Feb. 9, 2017.
European Search Report and Opinion issued in connection with related EP Application No. 16195207.2 dated Feb. 24, 2017.
GE Related Case Form.
U.S. Final Office Action issued in connection with related U.S. Appl. No. 14/585,158 dated Jul. 19, 2017.

* cited by examiner

AXIAL COMPRESSOR ROTOR INCORPORATING NON-AXISYMMETRIC HUB FLOWPATH AND SPLITTERED BLADES

STATEMENT REGARDING FEDERALLY SPONSORED RESEARCH AND DEVELOPMENT

The U.S. Government may have certain rights in this invention pursuant to contract no FA8650-09-D-2922 awarded by the Department of the Air Force.

BACKGROUND OF THE INVENTION

This invention relates generally to turbomachinery compressors and more particularly relates to rotor blade stages of such compressors.

A gas turbine engine includes, in serial flow communication, a compressor, a combustor, and turbine. The turbine is mechanically coupled to the compressor and the three components define a turbomachinery core. The core is operable in a known manner to generate a flow of hot, pressurized combustion gases to operate the engine as well as perform useful work such as providing propulsive thrust or mechanical work. One common type of compressor is an axial-flow compressor with multiple rotor stages each including a disk with a row of axial-flow airfoils, referred to as compressor blades.

For reasons of thermodynamic cycle efficiency, it is generally desirable to incorporate a compressor having the highest possible pressure ratio (that is, the ratio of inlet pressure to outlet pressure). It is also desirable to include the fewest number of compressor stages. However, there are well-known inter-related aerodynamic limits to the maximum pressure ratio and mass flow possible through a given compressor stage.

It is known to configure the disk with a non-axisymmetric "scalloped" surface profile to reduce mechanical stresses in the disk. An aerodynamically adverse side effect of this feature is to increase the rotor blade row through flow area and aerodynamic loading level promoting airflow separation.

Accordingly, there remains a need for a compressor rotor that is operable with sufficient stall range and an acceptable balance of aerodynamic and structural performance.

BRIEF DESCRIPTION OF THE INVENTION

This need is addressed by the present invention, which provides an axial compressor having a rotor blade row including compressor blades and splitter blade airfoils.

According to one aspect of the invention, a compressor apparatus includes: an axial flow rotor including: a disk mounted for rotation about a centerline axis, an outer periphery of the disk defining a flowpath surface having a non-axisymmetric surface profile; an array of airfoil-shaped axial flow compressor blades extending radially outward from the flowpath surface, wherein the compressor blades each have a root, a tip, a leading edge, and a trailing edge; and an array of airfoil-shaped splitter blades alternating with the compressor blades, wherein the splitter blades each have a root, a tip, a leading edge, and a trailing edge; and wherein at least one of a chord dimension of the splitter blades at the roots thereof and a span dimension of the splitter blades is less than the corresponding dimension of the compressor blades.

According to another aspect of the invention, the flowpath surface includes a concave scallop between adjacent compressor blades.

According to another aspect of the invention, the scallop has a minimum radial depth adjacent the roots of the compressor blades, and has a maximum radial depth at a position approximately midway between adjacent compressor blades.

According to another aspect of the invention, each splitter blade is located approximately midway between two adjacent compressor blades.

According to another aspect of the invention, the splitter blades are positioned such that their trailing edges are at approximately the same axial position as the trailing edges of the compressor blades, relative to the disk.

According to another aspect of the invention, the span dimension of the splitter blades is 50% or less of the span dimension of the compressor blades.

According to another aspect of the invention, the span dimension of the splitter blades is 30% or less of the span dimension of the compressor blades.

According to another aspect of the invention, the chord dimension of the splitter blades at the roots thereof is 50% or less of the chord dimension of the compressor blades at the roots thereof.

According to one aspect of the invention, a compressor apparatus includes a plurality of axial-flow stages, at least a selected one of the stages including: a disk mounted for rotation about a centerline axis, an outer periphery of the disk defining a flowpath surface having a non-axisymmetric surface profile; an array of airfoil-shaped axial flow compressor blades extending radially outward from the flowpath surface, wherein the compressor blades each have a root, a tip, a leading edge, and a trailing edge; and an array of airfoil-shaped splitter blades alternating with the compressor blades, wherein the splitter blades each have a root, a tip, a leading edge, and a trailing edge; and wherein at least one of a chord dimension of the splitter blades at the roots thereof and a span dimension of the splitter blades is less than the corresponding dimension of the compressor blades According to another aspect of the invention, the flowpath surface includes a concave scallop between adjacent compressor blades.

According to another aspect of the invention, the scallop has a minimum radial depth adjacent the roots of the compressor blades, and has a maximum radial depth at a position approximately midway between adjacent compressor blades.

According to another aspect of the invention, each splitter blade is located approximately midway between two adjacent compressor blades.

According to another aspect of the invention, the splitter blades are positioned such that their trailing edges are at approximately the same axial position as the trailing edges of the compressor blades, relative to the disk.

According to another aspect of the invention, the span dimension of the splitter blades is 50% or less of the span dimension of the compressor blades.

According to another aspect of the invention, the span dimension of the splitter blades is 30% or less of the span dimension of the compressor blades.

According to another aspect of the invention, the chord dimension of the splitter blades at the roots thereof is 50% or less of the chord dimension of the compressor blades at the roots thereof.

According to another aspect of the invention, the chord dimension of the splitter blades at the roots thereof is 50% or less of the chord dimension of the compressor blades at the roots thereof.

According to another aspect of the invention, the selected stage is disposed within an aft half of the compressor.

According to another aspect of the invention, the selected stage is the aft-most stage of the compressor.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
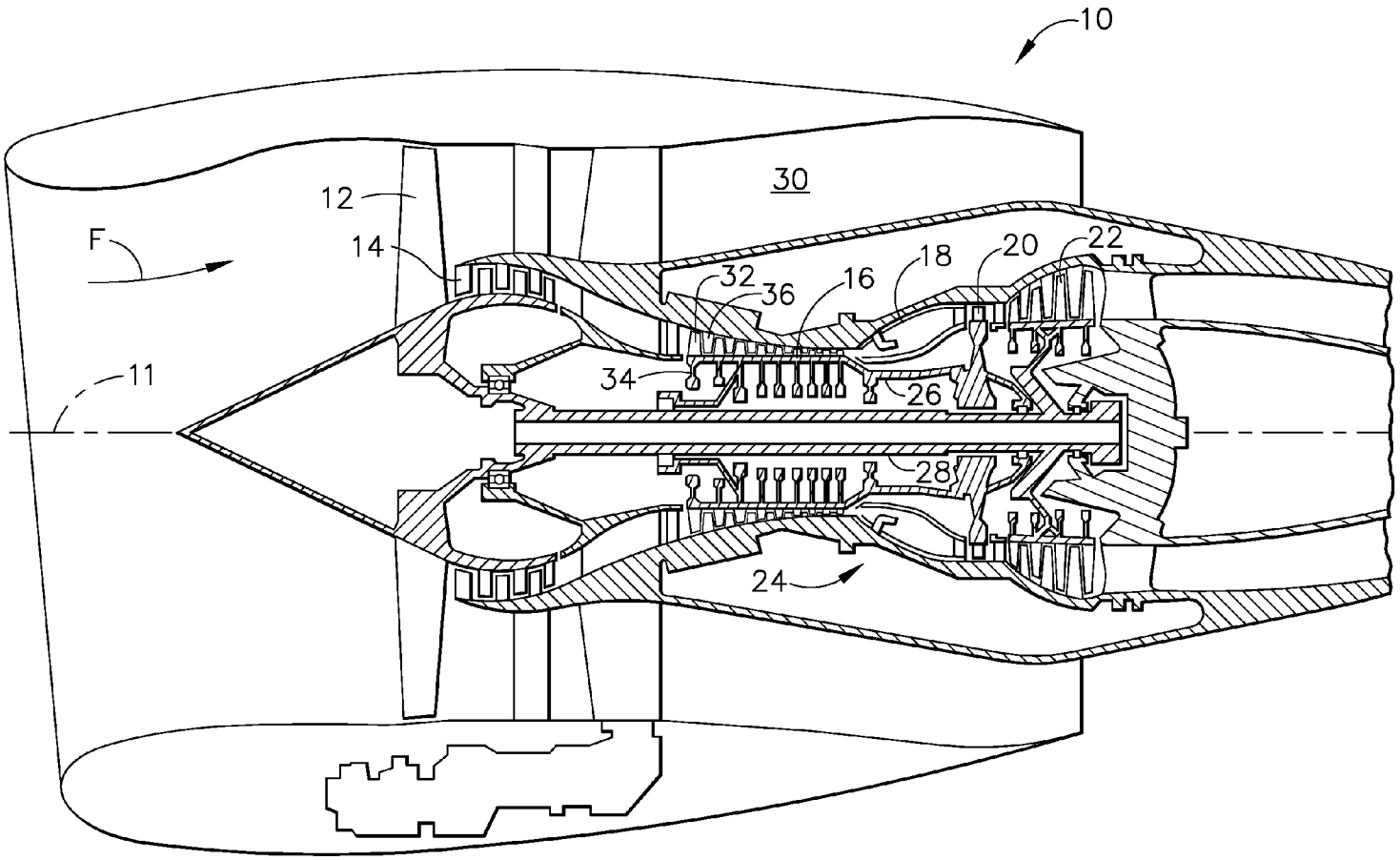
FIG. 1 is a cross-sectional, schematic view of a gas turbine engine that incorporates a compressor rotor apparatus constructed in accordance with an aspect of the present invention.
Figure 2:
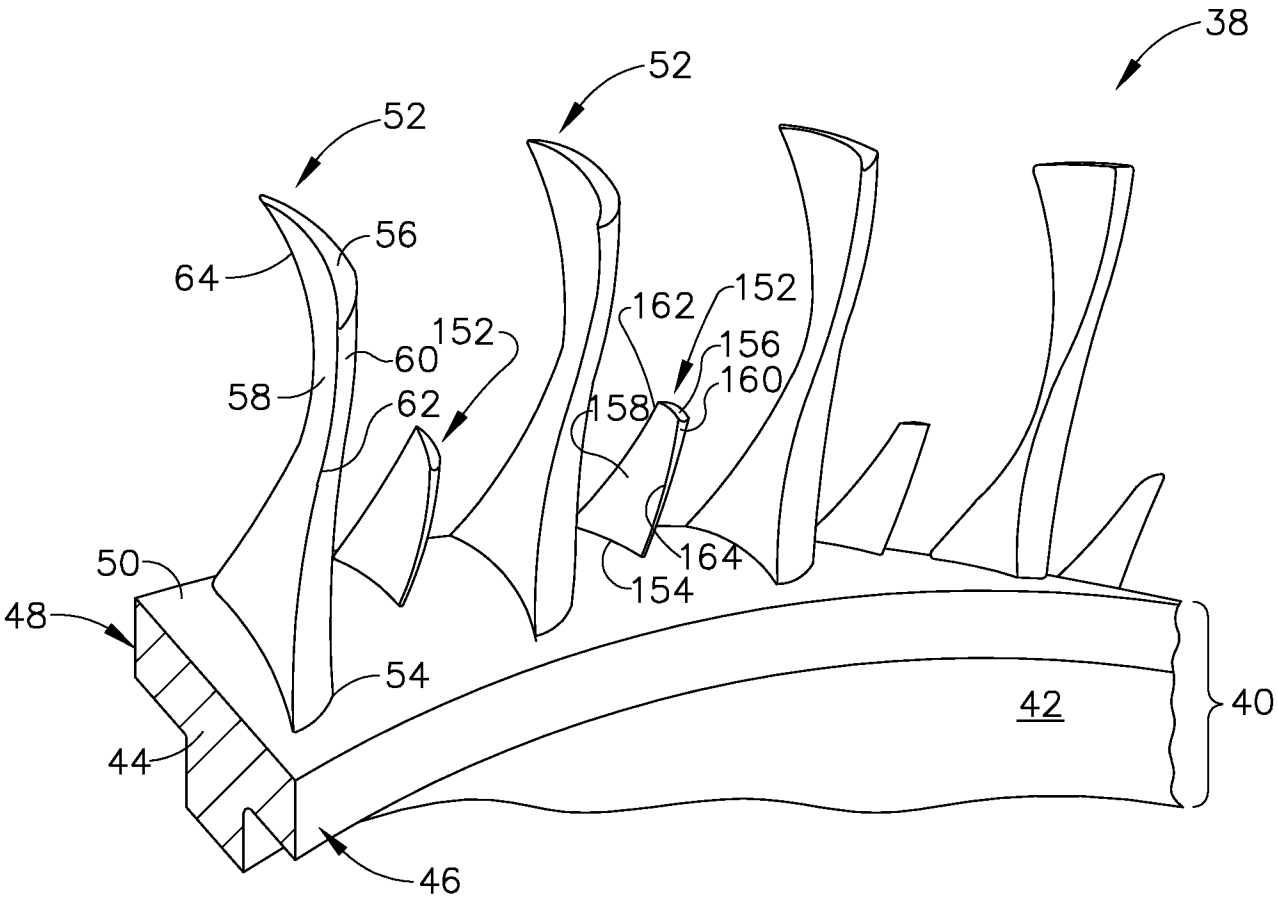
FIG. 2 is a perspective view of a portion of a rotor of a compressor apparatus.
Figure 3:
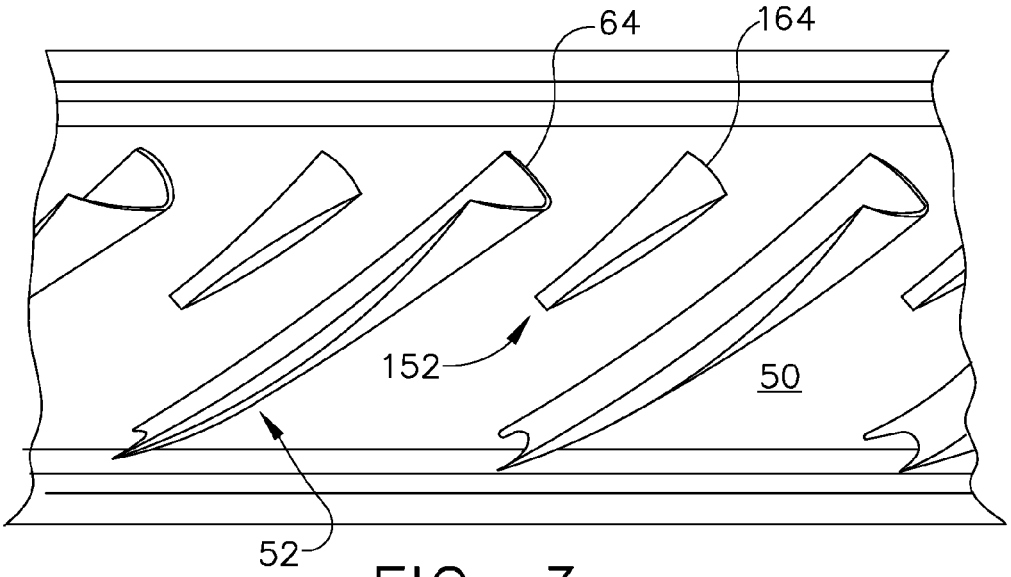
FIG. 3 is a top plan view of a portion of a rotor of a compressor apparatus.

Referring to the drawings wherein identical reference numerals denote the same elements throughout the various views, FIG. 1 illustrates a gas turbine engine, generally designated 10. The engine 10 has a longitudinal centerline axis 11 and includes, in axial flow sequence, a fan 12, a low-pressure compressor or "booster" 14, a high-pressure compressor ("HPC") 16, a combustor 18, a high-pressure turbine ("HPT") 20, and a low-pressure turbine ("LPT") 22. Collectively, the HPC 16, combustor 18, and HPT 20 define a core 24 of the engine 10. The HPT 20 and the HPC 16 are interconnected by an outer shaft 26. Collectively, the fan 12, booster 14, and LPT 22 define a low-pressure system of the engine 10. The fan 12, booster 14, and LPT 22 are interconnected by an inner shaft 28.

In operation, pressurized air from the HPC 16 is mixed with fuel in the combustor 18 and burned, generating combustion gases. Some work is extracted from these gases by the HPT 20 which drives the compressor 16 via the outer shaft 26. The remainder of the combustion gases are discharged from the core 24 into the LPT 22. The LPT 22 extracts work from the combustion gases and drives the fan 12 and booster 14 through the inner shaft 28. The fan 12 operates to generate a pressurized fan flow of air. A first portion of the fan flow ("core flow") enters the booster 14 and core 24, and a second portion of the fan flow ("bypass flow") is discharged through a bypass duct 30 surrounding the core 24. While the illustrated example is a high-bypass turbofan engine, the principles of the present invention are equally applicable to other types of engines such as low-bypass turbofans, turbojets, and turboshafts.

It is noted that, as used herein, the terms "axial" and "longitudinal" both refer to a direction parallel to the centerline axis 11, while "radial" refers to a direction perpendicular to the axial direction, and "tangential" or "circumferential" refers to a direction mutually perpendicular to the axial and tangential directions. As used herein, the terms "forward" or "front" refer to a location relatively upstream in an air flow passing through or around a component, and the terms "aft" or "rear" refer to a location relatively downstream in an air flow passing through or around a component. The direction of this flow is shown by the arrow "F" in FIG. 1. These directional terms are used merely for convenience in description and do not require a particular orientation of the structures described thereby.

The HPC 16 is configured for axial fluid flow, that is, fluid flow generally parallel to the centerline axis 11. This is in contrast to a centrifugal compressor or mixed-flow compressor. The HPC 16 includes a number of stages, each of which includes a rotor comprising a row of airfoils or blades 32 (generically) mounted to a rotating disk 34, and row of stationary airfoils or vanes 36. The vanes 36 serve to turn the airflow exiting an upstream row of blades 32 before it enters the downstream row of blades 32.

FIGS. 2-6 illustrate a portion of a rotor 38 constructed according to the principles of the present invention and suitable for inclusion in the HPC 16. As an example, the rotor 38 may be incorporated into one or more of the stages in the aft half of the HPC 16, particularly the last or aft-most stage.

The rotor 38 includes a disk 40 with a web 42 and a rim 44. It will be understood that the complete disk 40 is an annular structure mounted for rotation about the centerline axis 11. The rim 44 has a forward end 46 and an aft end 48. An annular flowpath surface 50 extends between the forward and aft ends 46, 48.

Figure 5:
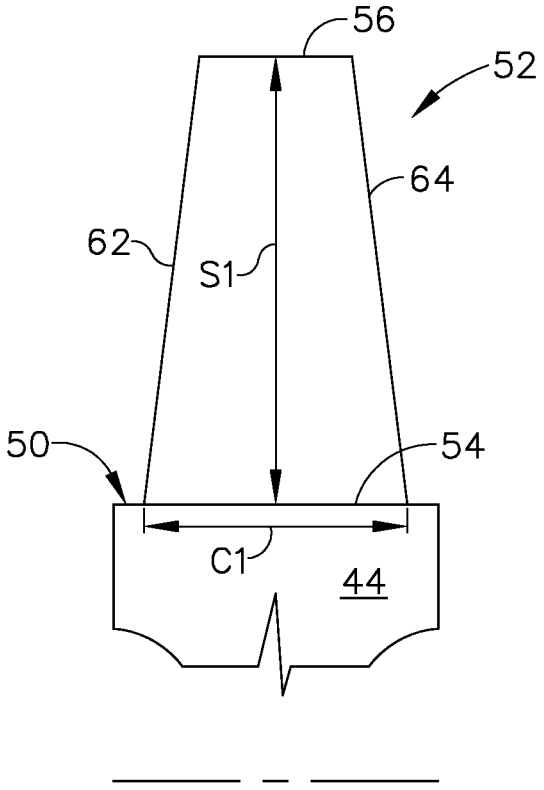
FIG. 5 is a side view taken along lines 5-5 of FIG. 4.

An array of axial flow compressor blades 52 extend from the flowpath surface 50. Each compressor blade extends from a root 54 at the flowpath surface 50 to a tip 56, and includes a concave pressure side 58 joined to a convex suction side 60 at a leading edge 62 and a trailing edge 64. As best seen in FIG. 5, each compressor blade 52 has a span (or span dimension) "S1" defined as the radial distance from the root 54 to the tip 56, and a chord (or chord dimension) "C1" defined as the length of an imaginary straight line connecting the leading edge 62 and the trailing edge 64. Depending on the specific design of the compressor blade 52, its chord C1 may be different at different locations along the span S1. For purposes of the present invention, the relevant measurement is the chord C1 at the root 54.

Figure 4:
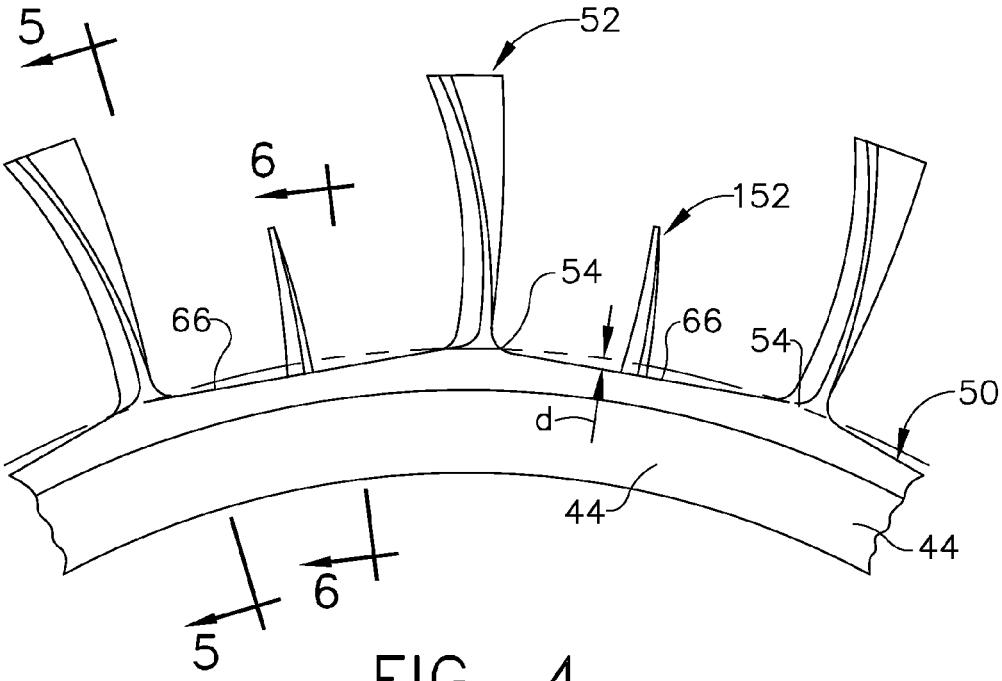
FIG. 4 is an aft elevation view of a portion of a rotor of a compressor apparatus.

As seen in FIG. 4, the flowpath surface 50 is not a body of revolution. Rather, the flowpath surface 50 has a non-axisymmetric surface profile. As an example of a non-axisymmetric surface profile, it may be contoured with a concave curve or "scallop" 66 between each adjacent pair of compressor blades 52. For comparison purposes, the dashed lines in FIG. 4 illustrate a hypothetical cylindrical surface with a radius passing through the roots 54 of the compressor blades 52. It can be seen that the flowpath surface curvature has its maximum radius (or minimum radial depth of the scallop 66) at the compressor blade roots 54, and has its minimum radius (or maximum radial depth "d" of the scallop 66) at a position approximately midway between adjacent compressor blades 52.

In steady state or transient operation, this scalloped configuration is effective to reduce the magnitude of mechanical and thermal hoop stress concentration at the airfoil hub intersections on the rim 44 along the flowpath surface 50. This contributes to the goal of achieving acceptably-long component life of the disk 40. An aerodynamically adverse side effect of scalloping the flowpath 50 is to increase the rotor passage flow area between adjacent compressor blades 52. This increase in rotor passage through flow area increases the aerodynamic loading level and in turn tends to cause undesirable flow separation on the suction side 60 of the compressor blade 52, at the inboard portion near the root 54, and at an aft location, for example approximately 75% of the chord distance C1 from the leading edge 62.

Figure 6:
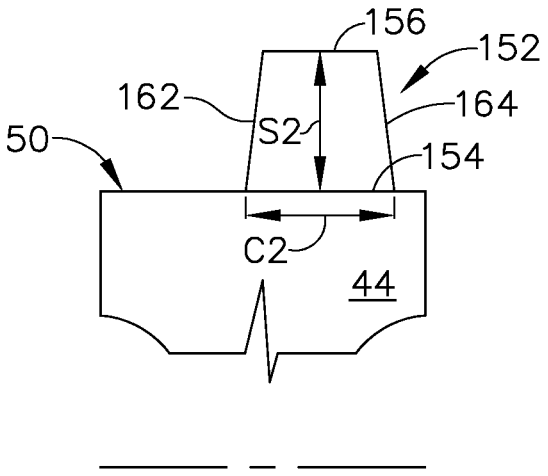
FIG. 6 is a side view taken along lines 6-6 of FIG. 4

An array of splitter blades 152 extend from the flowpath surface 50. One splitter blade 152 is disposed between each pair of compressor blades 52. In the circumferential direction, the splitter blades 152 may be located halfway or circumferentially biased between two adjacent compressor blades 52, or circumferentially aligned with the deepest portion d of the scallop 66. Stated another way, the compressor blades 52 and splitter blades 152 alternate around the periphery of the flowpath surface 50. Each splitter blade 152 extends from a root 154 at the flowpath surface 50 to a tip 156, and includes a concave pressure side 158 joined to a convex suction side 160 at a leading edge 162 and a trailing edge 164. As best seen in FIG. 6, each splitter blade 152 has a span (or span dimension) "S2" defined as the radial distance from the root 154 to the tip 156, and a chord (or chord dimension) "C2" defined as the length of an imaginary straight line connecting the leading edge 162 and the trailing edge 164. Depending on the specific design of the splitter blade 152, its chord C2 may be different at different locations along the span S2. For purposes of the present invention, the relevant measurement is the chord C2 at the root 154.

The splitter blades 152 function to locally increase the hub solidity of the rotor 38 and thereby prevent the above-mentioned flow separation from the compressor blades 52. A similar effect could be obtained by simply increasing the number of compressor blades 152, and therefore reducing the blade-to-blade spacing. This, however, has the undesirable side effect of increasing aerodynamic surface area frictional losses which would manifest as reduced aerodynamic efficiency and increased rotor weight. Therefore, the dimensions of the splitter blades 152 and their position may be selected to prevent flow separation while minimizing their surface area. The splitter blades 152 are positioned so that their trailing edges 164 are at approximately the same axial position as the trailing edges of the compressor blades 52, relative to the rim 44. This can be seen in FIG. 3. The span S2 and/or the chord C2 of the splitter blades 152 may be some fraction less than unity of the corresponding span S1 and chord C1 of the compressor blades 52. These may be referred to as "part-span" and/or "part-chord" splitter blades. For example, the span S2 may be equal to or less than the span S1. Preferably for reducing frictional losses, the span S2 is about 50% or less of the span S1. More preferably for the least frictional losses, the span S2 is about 30% or less of the span S1. As another example, the chord C2 may be equal to or less than the chord C1. Preferably for the least frictional losses, the chord C2 is about 50% or less of the chord C1.

The disk 40, compressor blades 52, and splitter blades 152 may be constructed from any material capable of withstanding the anticipated stresses and environmental conditions in operation. Non-limiting examples of known suitable alloys include iron, nickel, and titanium alloys. In FIGS. 2-6 the disk 40, compressor blades 52, and splitter blades 152 are depicted as an integral, unitary, or monolithic whole. This type of structure may be referred to as a "bladed disk" or "blisk". The principles of the present invention are equally applicable to a rotor built up from separate components (not shown).

The rotor apparatus described herein with splitter blades increases the rotor hub solidity level locally, reduces the hub aerodynamic loading level locally, and suppresses the tendency of the rotor airfoil hub to want to separate in the presence of the non-axisymmetric contoured hub flowpath surface. The use of a partial-span and/or partial-chord splitter blade is effective to keep the solidity levels of the middle and upper sections of the rotor unchanged from a nominal value, and therefore to maintain middle and upper airfoil section performance.

The foregoing has described a compressor rotor apparatus. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends any novel one, or any novel combination, of the features disclosed in this specification (including any accompanying claims, abstract and drawings), or to any novel one, or any novel combination, of the steps of any method or process so disclosed.

What is claimed is:

1. A compressor apparatus comprising:

an axial flow rotor comprising:

a disk mounted for rotation about a centerline axis, an outer periphery of the disk defining a flowpath surface having a non-axisymmetric surface profile;

an array of airfoil-shaped axial flow compressor blades extending radially outward from the flowpath surface, wherein the array of compressor blades each have a root, a tip, a leading edge, and a trailing edge; and an array of airfoil-shaped splitter blades alternating with the compressor blades, wherein the array of splitter blades each have a root, a tip, a leading edge, and a trailing edge;

wherein both a chord dimension of each splitter blade of the array of splitter blades at the roots thereof and a span dimension of each splitter blade of the array of splitter blades are less than the corresponding dimension of the compressor blades;

wherein the splitter blade chord is parallel to the compressor blade chord, at the roots thereof, wherein each of the blades of the array of splitter blades are positioned such that their trailing edges are at approximately the same axial position as the trailing edges of the compressor blades, relative to the disk, wherein the flowpath surface includes a concave scallop between adjacent compressor blades, wherein each splitter blade of the array of splitter blades is circumferentially aligned with a deepest portion of the concave scallop, wherein the selected stage is the aft-most stage of the compressor, and wherein a forward-most stage of the compressor is unsplittered.

2. The apparatus of claim 1 wherein the flowpath surface includes a concave scallop between adjacent compressor blades.

3. The apparatus of claim 2 wherein the concave scallop has a minimum radial depth adjacent the roots of the compressor blades, and has a maximum radial depth at a position approximately midway between adjacent compressor blades.

4. The apparatus of claim 1 wherein each splitter blade of the array of splitter blades is located approximately midway between two adjacent compressor blades.

5. The apparatus of claim 1 wherein the span dimension of each splitter blade of the array of splitter blades is 50% or less of the span dimension of the compressor blades.

6. The apparatus of claim 1 wherein the span dimension of each splitter blade of the array of splitter blades is 30% or less of the span dimension of the compressor blades.

7. The apparatus of claim 6 wherein the chord dimension of each splitter blade of the array of splitter blades at the roots thereof is 50% or less of the chord dimension of the compressor blades at the roots thereof.

8. The apparatus of claim 1 wherein the chord dimension of each splitter blade of the array of splitter blades at the roots thereof is 50% or less of the chord dimension of the compressor blades at the roots thereof.

9. A compressor apparatus including a plurality of axial-flow stages, at least a selected one of the stages comprising:

a disk mounted for rotation about a centerline axis, an outer periphery of the disk defining a flowpath surface having a non-axisymmetric surface profile;

an array of airfoil-shaped axial flow compressor blades extending radially outward from the flowpath surface, wherein the array of compressor blades each have a root, a tip, a leading edge, and a trailing edge; and an array of airfoil-shaped splitter blades alternating with the compressor blades, wherein the array of splitter blades each have a root, a tip, a leading edge, and a trailing edge;

wherein both a chord dimension of each splitter blade of the array of splitter blades at the roots thereof and a span dimension of each splitter blade of the array of splitter blades are less than the corresponding dimension of the compressor blades;

wherein the splitter blade chord is parallel to the compressor blade chord, at the roots thereof, wherein the array of splitter blades are positioned such that their trailing edges are at approximately the same axial position as the trailing edges of the compressor blades, relative to the disk, wherein the flowpath surface includes a concave scallop between adjacent compressor blades, wherein each splitter blade of the array of splitter blades is circumferentially aligned with a deepest portion of the concave scallop, wherein the selected stage is the aft-most stage of the compressor, and wherein a forward-most stage of the compressor is un-splittered.

10. The apparatus of claim 9 wherein the concave scallop has a minimum radial depth adjacent the roots of the compressor blades, and has a maximum radial depth at a position approximately midway between adjacent compressor blades.

11. The apparatus of claim 9 wherein each splitter blade of the array of splitter blades is located approximately midway between two adjacent compressor blades.

12. The apparatus of claim 11 wherein the span dimension of each splitter blade of the array of splitter blades is 50% or less of the span dimension of the array of compressor blades; and wherein the length of the chord of each splitter blade of the array of splitter blade decreases in the radial direction along the splitter blade span.

13. The apparatus of claim 12 wherein the span dimension of each splitter blade of the array of splitter blades is 30% or less of the span dimension of the compressor blades.

14. The apparatus of claim 13 wherein the chord dimension of each splitter blade of the array of splitter blades at the roots thereof is 50% or less of the chord dimension of the compressor blades at the roots thereof.

15. The apparatus of claim 9 wherein the chord dimension of each splitter blade of the array of splitter blades at the roots thereof is 50% or less of the chord dimension of the compressor blades at the roots thereof.

* * * * *